US009230470B2

(12) United States Patent
Ryu

(10) Patent No.: US 9,230,470 B2
(45) Date of Patent: Jan. 5, 2016

(54) DATA DRIVER AND A DISPLAY APPARATUS INCLUDING THE SAME

(71) Applicant: Choong Sik Ryu, Anyang-si (KR)

(72) Inventor: Choong Sik Ryu, Anyang-si (KR)

(73) Assignee: Dongbu HiTek Co., Ltd., Bucheon-si (KR)

( * ) Notice: Subject to any disclaimer, the term of this patent is extended or adjusted under 35 U.S.C. 154(b) by 0 days.

(21) Appl. No.: 14/503,300

(22) Filed: Sep. 30, 2014

(65) Prior Publication Data

US 2015/0339962 A1 Nov. 26, 2015

(30) Foreign Application Priority Data

May 21, 2014 (KR) ..... 10-2014-0060848

(51) Int. Cl.
*G09G 3/36* (2006.01)
*G09G 3/20* (2006.01)

(52) U.S. Cl.
CPC ..... *G09G 3/20* (2013.01); *G09G 2300/08* (2013.01); *G09G 2310/06* (2013.01)

(58) Field of Classification Search
CPC . G09G 3/20; G09G 2300/08; G09G 2310/06; G09G 2310/0289; G09G 2310/027; G09G 2310/0297; G09G 3/3685; H03M 1/10
See application file for complete search history.

(56) References Cited

U.S. PATENT DOCUMENTS 7,656,378 B2 2/2010 Hashimoto
7,656,419 B2 2/2010 Hashimoto
7,812,804 B2 10/2010 Hashimoto
8,598,934 B2 12/2013 Otani et al.
2005/0206635 A1 9/2005 Hashimoto
2009/0040204 A1 2/2009 Hashimoto
2009/0040245 A1 * 2/2009 Hashimoto ..... G09G 3/3614 345/690
2011/0050746 A1 * 3/2011 Tsuchi ..... G09G 3/20 345/690
2012/0038611 A1 2/2012 Otani et al.
2013/0082852 A1 * 4/2013 Coban ..... H03M 1/20 341/110

FOREIGN PATENT DOCUMENTS

KR 1020000006515 1/2000
KR 1020030002897 1/2003
KR 1020060043698 5/2006
KR 1020120016594 2/2012

OTHER PUBLICATIONS

Notice of Allowance dated Feb. 13, 2015, from the Korean Intellectual Property Office (KIPO), Korea, for Korean Patent Application No. 10-2014-0060848; 6 pgs.
Yoshiharu Hashimoto; "Drive Circuit for Display Apparatus and Display Apparatus", Abstract of Korean Publication No. 1020060043698; Publication Date: May 15, 2006.
(Continued)

*Primary Examiner* — Premal Patel
(74) *Attorney, Agent, or Firm* — Andrew D. Fortney; Central California IP Group, P.C.

(57) ABSTRACT

A data driver includes a data storage unit configured to store a data signal therein, a level shifting block configured to shift a level of the data signal and output a level shifted data signal based on the result of the level shifting, a waveform conversion block configured to convert a waveform of the level shifted data signal and generate a conversion data signal (e.g., based on the waveform conversion), and a digital-analog conversion unit configured to output an analog signal based on the conversion data signal, wherein the conversion data signal has a rising time and a descending time that are different from each other.

20 Claims, 7 Drawing Sheets

(56) References Cited

OTHER PUBLICATIONS

Keigo Otani; "Level Shifter Circuit and Display Driver Circuit", Abstract of Korean Publication No. 1020120016594; Publication Date: Feb. 24, 2012.

Seung Shin; "Source Driver in LCD", Abstract of Korean Publication No. 1020030002897; Publication Date: Jan. 9, 2000.

Ryoichi Yokoyama and Naoaki Komiya; "Method for Driving a Liquid Crystal Display", Abstract of Korean Publication No. 1020000006515; Publication Date: Jan. 25, 2000.

* cited by examiner (Representative of Background Art)

(Background Art)

DATA DRIVER AND A DISPLAY APPARATUS INCLUDING THE SAME

This application claims priority from and the benefit of Korean Patent Application No. 10-2014-0060848, filed on May 21, 2014, which is hereby incorporated by reference for all purposes as if fully set forth herein.

BACKGROUND OF THE DISCLOSURE

1. Field of the Disclosure

Exemplary embodiments of the disclosure relate to a data driver and a display apparatus including the same.

2. Discussion of the Background

An R-string type converter is broadly used as a digital-analog converter in a data driver for driving data lines of a display panel.

FIG. 11 is a diagram illustrating a conventional R-string type digital-analog converter.

Referring to FIG. 11, the digital-analog converter may turn switches (SW1 through SW6) on or off based on digital data (e.g., D1 through D4), and output one of a plurality of voltages distributed by resistor string 901 having resistors (R1 through R4) connected in series by switching of the switches (SW1 through SW6) as an analog signal (Va).

When the switches (SW1 through SW6) are turned on or off in response to the data (D1 through D4), a through current (910, 920 or 930) may flow between the resistor string 910 and the switches (SW1 through SW6). The through current (910, 920 or 930) may be provided during a period where the switches (SW1 and SW3, SW and S4) are turned on simultaneously. A current path (path1, path2 or path 3) flowing through the switches turned on simultaneously may be formed in that period.

In case such a through current is generated, fluctuation might be caused in a waveform of the distributed voltage provided by the resistor string, and such fluctuation could lengthen the time taken for the output of the digital-analog converter to reach a final voltage. Accordingly, the speed of digital-analog conversion may be reduced.

SUMMARY OF THE DISCLOSURE

Exemplary embodiments of the present disclosure provide a data driver that may curb the fluctuations generated in a distributed voltage of a resistor string of a digital-analog converter and prevent the speed of the digital-analog conversion from being lowered by such fluctuations, and a display apparatus including the same.

Exemplary embodiments of the present disclosure relate to a data driver including a data storage unit configured to store a data signal therein; a level shifting block configured to shift a level of the data signal and output a level shifted data signal (e.g., based on the result of the level shifting); a waveform conversion block configured to convert a waveform of the level shifted data signal and generate a conversion data signal (e.g., based on the waveform conversion); and a digital-analog conversion unit configured to output an analog signal based on the conversion data signal, wherein the conversion data signal has a rising time and a descending time that are different from each other.

The digital-analog conversion unit may include a voltage distribution unit comprising resistors serially connected between a first power or power supply and a second power or power supply, configured to output distributed voltages, each with a different level; and a decoder comprising a plurality of switches turned on or turned off in response to the conversion data signal, configured to output one of the distributed voltages (e.g., based on switching of the switches).

The waveform conversion block may comprise an inverter having a high level pull up time and a low level pull down time that is different from the high level pull up time.

The waveform conversion block may include a CMOS inverter configured to invert the level shifted data signal, a first bias switch connected to the CMOS inverter and that receives a first bias signal, and an output node linked to the first bias switch and the CMOS inverter that outputs the conversion data signal. The CMOS inverter may comprise a first switch and a second switch.

The first switch in the CMOS inverter and the first bias switch may each comprise an NMOS transistor, and the second switch in the CMOS inverter may comprise a PMOS transistor.

Alternatively, the second switch may be a NMOS transistor, and the bias switch and the first switch are PMOS transistors.

The level shifted data signal may include a non-inverted level shifted data signal and an inverted level shifted data signal, and the inverted level shifted data signal may be an inverted signal of the non-inverted shifted data signal.

The conversion data signal may include a non-inverted conversion signal and an inverted conversion data signal, and the inverted conversion data signal may be an inverted signal of the non-inverted conversion data signal.

The non-inverted conversion data signal may have a rising time and a descending time that are different, and the inverted conversion data signal may has a rising time and a descending time that are different.

The rising time of the conversion data signal may be shorter than the descending time of the conversion data signal.

Alternatively, the rising time of the conversion data signal may be longer than the descending time of the conversion data signal.

Exemplary embodiments of the present disclosure also provide a data driver including a data storage unit configured to store a data signal therein; a level shifting block configured to shift a level of the data signal and output a level shifted data signal (e.g., based on the result of the level shifting); a waveform conversion block configured to convert a waveform of the level shifted data signal and generate a conversion data signal (e.g., based on the waveform conversion); and a plurality of digital-analog conversion units comprising a voltage distributor configured to output distributed voltages, each with a different level, and a plurality of switches turned on or off in response to the conversion data signal, configured to output one of the distributed voltages (e.g., through the switching of the switches), wherein each of the switches has a turned-on time and a turned-off time that are different from each other.

Each turned-off time of the switches may be shorter than each turned-off time.

The voltage distributor may include resistors serially connected between a first power or power supply and a second power or power supply.

The level shifting block may include a plurality of level shifters, and each of the level shifters may shift a level of the data signal and a level of the inverted data signal, and output a non-inverted level shifted data signal and an inverted level shifted data signal.

The waveform conversion block may include a plurality of wave converters (the number of which may correspond to the number of level shifters in the plurality of the level shifters), and each of the waveform converters generates a waveform of the non-inverted level shifted data signal and a waveform of the inverted level shifted data signal and generates a non-inverted conversion data signal and an inverted conversion data signal (e.g., based on the result of the conversion). The non-inverted level shifted data signal and the inverted level shifted data signal turn the switches on or off.

Each of the waveform converters may comprise or be an inverter having a high level pull up time and a low level pull down time that is different from the high level pull-up time.

Each of the waveform converters may include a CMOS inverter configured to invert the level shifted data signal; and a first bias switch connected to the CMOS inverter and that receives a first bias signal. Each waveform converter may output the conversion data signal via an output node to which the first bias switch and the CMOS inverter are linked.

The CMOS inverter may comprise a first switch and a second switch connected in an inverter structure, the first switch and the first bias switch may be or comprise NMOS transistors, and the second switch may be or comprise a PMOS transistor. Alternatively, the second switch may be or comprise a NMOS transistor, and the bias switch and the first switch may be or comprise PMOS transistors.

Exemplary embodiments of the present disclosure also provide a display apparatus including a display panel having gate lines arranged in rows and data lines arranged in columns (or vice versa), with the gate lines and the data lines crossing each other in a matrix, and pixels connected to crossed portions of the gate lines and the data lines; a gate driver configured to drive the gate lines; and a data driver configured to drive the data lines, wherein the data driver may include a data storage unit configured to store a data signal therein; a level shifting block configured to shift a level of the data signal and output a level shifted data signal (e.g., based on the result of the level shifting); a waveform conversion block configured to convert a waveform of the level shifted data signal and generate a conversion data signal (e.g., based on the waveform conversion); and a plurality of digital-analog conversion units including a voltage distributor configured to output distributed voltages, each with a different level, and a plurality of switches turned on or off in response to the conversion data signal, configured to output one of the distributed voltages (e.g., through the switches), and the conversion data signal may have a rising time and a descending time that are different from each other.

According to embodiments of the disclosure, the display apparatus may suppress fluctuations generated in the distributed voltages of the resistor string in the digital-analog converter and enhance the digital-analog conversion speed of the digital-analog converter in the data drive.

BRIEF DESCRIPTION OF THE DRAWINGS

The accompanying drawings, which are included to provide a further understanding of the disclosed subject matter and are incorporated in and constitute a part of this specification, illustrate exemplary embodiments of the disclosed subject matter, and together with the description serve to explain the principles of the disclosed subject matter.

DETAILED DESCRIPTION OF THE ILLUSTRATED EMBODIMENTS

Figure 1:
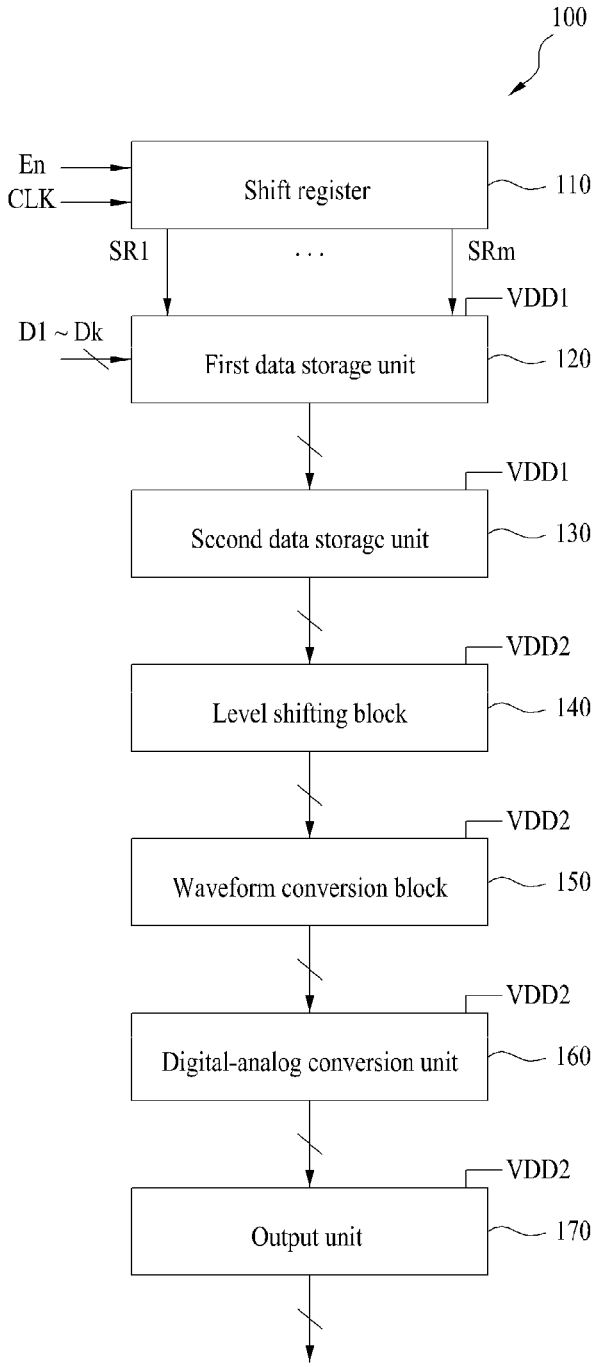
FIG. 1 is a block diagram of a data driver according to exemplary embodiments of the present disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements. It will be understood that when an element or layer is referred to as being "on", "connected to", or "coupled to" another element or layer, it can be directly on, connected, or coupled to the other element or layer, or intervening elements or layers may be present. In contrast, when an element is referred to as being "directly on", "directly connected to", or "directly coupled to" another element or layer, there are no intervening elements or layers present.

Exemplary embodiments of the disclosed subject matter are described herein with reference to cross-section illustrations that are schematic illustrations of idealized embodiments (and intermediate structures) of the disclosed subject matter. As such, variations from the shapes of the illustrations as a result, for example, of manufacturing techniques and/or tolerances, are to be expected. Thus, exemplary embodiments of the disclosed subject matter should not be construed as limited to the particular shapes or arrangements of regions illustrated herein, but are to include deviations or variations in shapes that result, for example, from manufacturing. Unless otherwise defined, all terms (including technical and scientific terms) used herein have the same meaning as commonly understood by one of ordinary skill in the art to which this disclosed subject matter belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
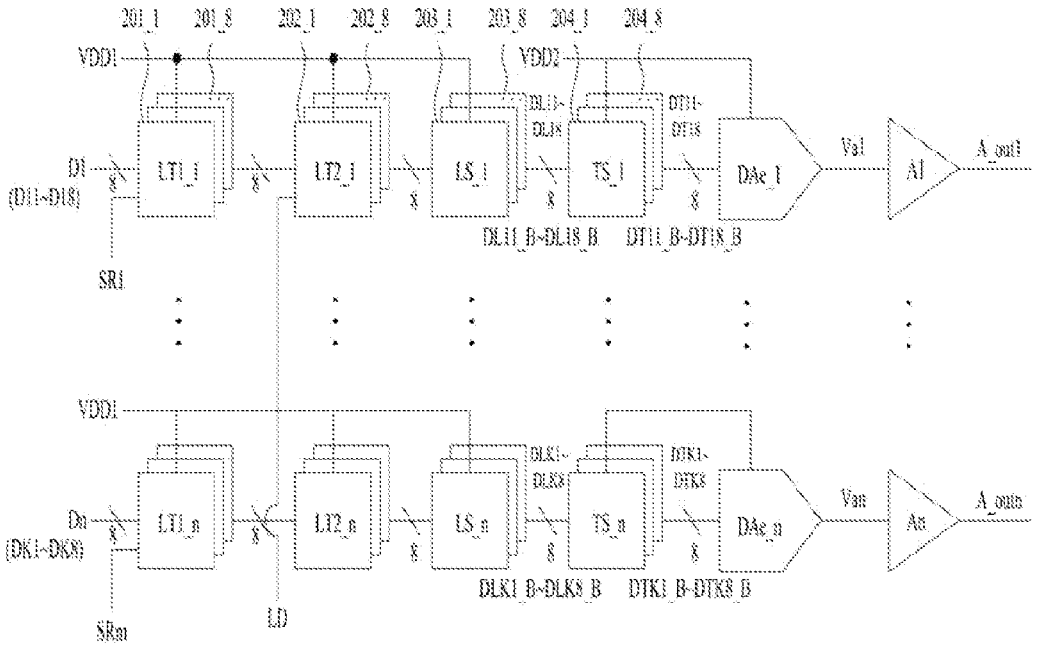
FIG. 2 is a diagram illustrating one embodiment of a data storage unit, a second data storage unit, a level shifting block, a waveform conversion block, a digital-analog conversion unit and an output unit which are shown in FIG. 1.

FIG. 1 is a block diagram of a data driver 100 according to exemplary embodiments of the present disclosure. FIG. 2 is a diagram illustrating one embodiment of a data storage unit 120, a second data storage unit 130, a level shifting block 140, a waveform conversion block 150, a digital-analog conversion unit 160 and an output unit 170 which are shown in FIG. 1.

Referring to FIGS. 1 and 2, the data driver 100 includes a shift register 110, a first data storage unit 120, a second data storage unit 130, a level shifting block 140, a waveform conversion block 150, a digital-analog conversion unit 160 and an output unit 170.

The shift register 110 generates a shift signal (SR1 through SRm, where m is a natural number that is greater than 1) in response to an enable signal (En) and a clock signal (CLK) to control timing in which data (e.g., digital video data) is sequentially stored in the first latch unit 120.

For instance, the shift register 110 receives a start signal from a timing controller (205, see FIG. 8) and shifts the received start signal in response to certain transitions or levels of the clock signal (CLK) into shift signals (SR1 through SRm, where m is a natural number greater than 1). At this time, the horizontal start signal is used together with Start Pulse.

The first data storage unit 120 stores the data (D1~Dk, where k is a natural number greater than 1) received from a timing controller (205, see FIG. 10) therein, in response to shift signals (SR1 through SRm, where m is a natural number greater than 1) generated by the shift register 110.

The first data storage unit 120 may include a plurality of latch units (LT1_1 through LT-n, where n is a natural number greater than 1). A first set of latch units (LT1_1 through LT1_*n*, where n is a natural number greater than 1) may be divided into a plurality of groups. Each of the latch units (LT1_1 through LT1_*n*, where n is a natural number greater than 1) may store Q bit (e.g., where Q=8) data signals therein.

Each of the groups may include at least one first latch unit. When each of the groups includes a plurality of first latch units, the first latch units that belong to each of the groups do not overlap with each other.

For instance, each of the groups may include first latch units (e.g., LT1_1 through LT1_3).

Three first latch units (e.g., LT1_1, LT1_2 and LT1_3) may store R (red color) data, G (green color) data, and B (blue color) data (e.g., R1, G1 and B1) therein.

Each of the first latch units (e.g., LT1_1 through LT1-3) may include a plurality of first latches (e.g., 201_1 through 201_8) configured to store Q-bit data signals (e.g., Q=8, although Q can equal any integer of at least 2 [e.g., $2^x$, where x is a natural number greater than 1]).

The R data may be stored in the foremost first latch unit that belongs to each of the groups, and the G data may be stored in the next latch unit. The B data may be stored in the third first-latch unit. The R data, the G data and the B data may be Q-bit data signals (where Q is a natural number greater than 1, e.g., Q=8).

For instance, each of the shift signals (SR1 through SRm, where m is a natural number greater than 1) may be provided to the first latch units that belongs to each of the groups. In response to the shift signal (e.g., SR1), Q-bit data signals (R1, G1 and B1) may be simultaneously stored in latches in each of the first latch units (e.g., LT1_1 through LT1_3) that belongs to each group.

The second data storage unit 130 may store Q-bit data signals output from the first data storage unit 120 therein, in response to a first control signal (LD). For instance, the second data storage unit 130 may store the data signals output from the first data storage unit 120 by a unit horizontal line period therein.

For instance, the horizontal line period may be the period required to completely store data corresponding to one horizontal line (204, see FIG. 10) of a display panel (201, see FIG. 10) in the first latch units (LT1_1 through LT1_*n*, where n is a natural number greater than 1) of the first data storage unit 120.

The second data storage unit 130 may include a plurality of second latch units (LT2_1 through LT2_*n*, where n is a natural number greater than 1) and the number of the second latches may be equal to the number of the first latch units (LT1_1 through LT1_*n*, where n is a natural number greater than 1). Each of the second latch units (LT2_1 through LT2_*n*, where n is a natural number greater than 1) may include a plurality of second latches (e.g., 202-1 through 202-8) corresponding to the first latches in each of the first latch units (LT1_1 through LT1_*n*). Q-bit data signals (e.g., where Q=8) may be stored in the second latches in each of the second latch units (LT2_1 through LT2_*n*, where n is a natural number greater than 1). The number of the second latches may be equal to the number of the first latches.

The plurality of the second latch units (LT2_1 through LT2_*n*, where n is a natural number greater than 1) may store the data signals provided by the first latch units (LT1_1 through LT1_*n*, where n is a natural number greater than 1), in response to a first control signal (LD).

For instance, in response to the first control signal (LD), the data signals (D11 through D18~Dk1 through Dk8) stored in each of the first latch units (LT1_1 through LT1_*n*, where n is a natural number greater than 1) may be simultaneously stored in the second latch units (LT2_1 through LT2_*n*, where n is a natural number greater than 1).

The level shifting block 140 shifts a voltage level of the data signals (D11 through D18~Dk1 through Dk8) from the second data storage unit 130. A driving voltage (VDD2) of the level shifting block 140 may be higher than the driving voltage (VDD1) of each of the first data storage unit 120 and the second data storage unit 130.

The level shifting unit 140 may include a plurality of level shifter units (LS_1 through LS_n, where n is a natural number greater than 1).

Each of the level shifter units (LS_1 through LS_n, where n is a natural number greater than 1) may correspond to one of the second latch units (LT2_1 through LT2_*n*, where n is a natural number greater than 1).

Each of the level shifter units (LS_1 through LS_n, where n is a natural number greater than 1) may include level shifters (e.g., 203-1 through 203-8) corresponding to the second latches.

Each of the level shifter units (LS_1 through LS_n, where n is a natural number greater than 1) shifts a voltage level of the data signals stored in the second latch units (LT2_1 through LTs_n, where n is a natural number greater than 1), and outputs shifted data signals having a shifted voltage level and inverted level shifted data signals.

For instance, the level shifter unit (LS_1) may output the level shifted data signals (DL11 through DL 18), e.g. according to the result of the voltage level shifting of the data signals (D11 through D18) stored in the second latch unit (LT2_1) and the inverted shifted data signals (DL11_B through DL18_B).

Each of the level shifters (203-1 through 203-8) shifts a voltage of the data signal (D11) and a level of the inverted data signal (D11_B), and outputs the level shifted data signals (DL11 through DL18) and the inverted level shifted data signals (DL11_B through DL18_B), e.g. based on the result of the level shifting.

For instance, the level shifter 203-1 may shift a level of the data signal D11 stored in the second latch 202-1 and a level of an inverted data signal (D11_B), and output the level shifted data signal (DL11) based on the shifting result and the inverted level shifted data signal (DL11_B).

The inverted data signal (D11_B) may be the signal inverted from the data signal (D11). The level shifter unit (LS_1) may include an inverter (not shown) configured to invert the data signal (D11) and output the inverted data signal (D11_B).

The waveform conversion block 150 may convert a waveform of the level shifted data signals (DL11 through DL18~DLk1 through Dk8) and a waveform of the inverted level shifted data signals (DL11_B through D18_B~DLk1_B through DLk8_B), and it may output the conversion data signals (DT11 through DT18~DTk1 through DTk8) and the inverted conversion data signals (DT11_B through DT18_B~DTk1 through DTk8_B) based on the conversion result.

The conversion data signals (DT11 through DT18~DTk1 through DTk8) and the inverted conversion data signals (DL11_B through D18_B~DLk1_B through DLk8_B) may be signals having a changed rising time and a changed descending time, compared with the level shifted data signals (DL11 through DL18~DLk1 through Dk8) and the inverted level shifted data signals (DL11_B through D18_B~DLk1_B through DLk8_B).

The waveform conversion unit 150 may include a plurality of waveform conversion units (TS_1 through TS_n, where n is a natural number greater than 1) corresponding to the plurality of the level shifter units (LS_1 through LS_n, where n is a natural number greater than 1).

Each of the waveform conversion units (TS_1 through TS_n, where n is a natural number greater than 1) may include a plurality of waveform converters (204-1 through 204-8) corresponding to the level shifters (203-1 through 203-8) in each of the level shifter units (LS_1 through LS-N, where n is a natural number greater than 1).

Each of the waveform converters 204-1 through 204-8 converts a level shifted data signal output from a corresponding one of the level shifters 203-1 through 203-8 and a waveform of the inverted level shifted data signal, and it generates a conversion data signal and an inverted conversion data signal (e.g., based on the conversion result).

Figure 3:
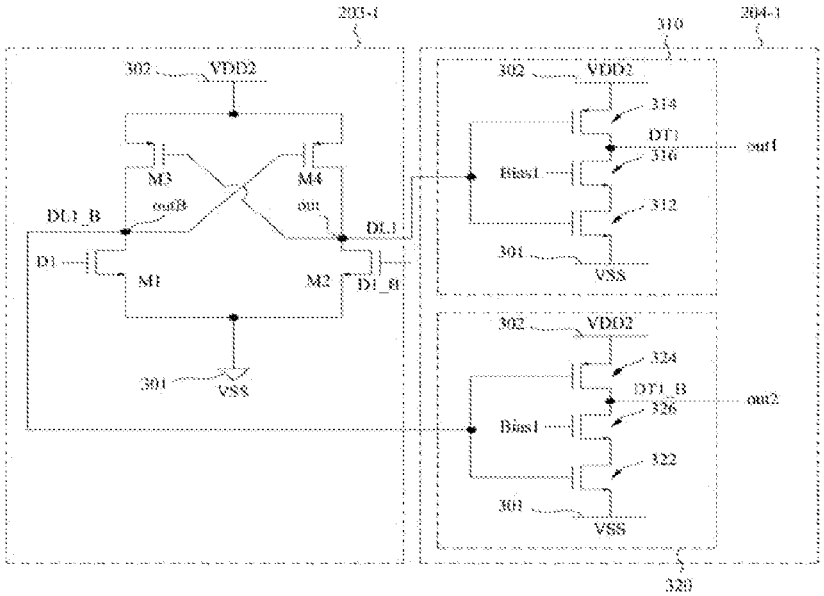
FIG. 3 is a diagram illustrating one embodiment of a level shifter and a waveform converter which are shown in FIG. 2.

FIG. 3 is a diagram illustrating one embodiment of a level shifter 203-1 and a waveform converter that are shown in FIG. 2.

Referring to FIG. 3, the level shifter 203-1 receives the data signal (D11) and the inverted data signal (D11B) and outputs the level shifted data signal (DL11) and the inverted level shifted data signal (D11_B).

The level shifter 203-1 may be implemented and/or realized by first through fourth transistors (M1 through M4), but embodiments of the disclosure are not limited thereto. It may be realized by diverse types of level shifters.

The first transistor (M1) may include a first gate having the data signal (D11) input thereto, a first source connected to a first power or power supply 301, and a first drain connected to an inverted output node (OUTB).

The second transistor (M2) may include a second gate having the inverted first data signal (D11_B) input thereto, a second source connected to the first power or power supply 301, and a second drain connected to an output node (OUT).

The third transistor (M3) may include a third gate connected to an inverted output node (OUT), a third source connected to a second power or power supply 302, and a third drain connected to the inverted output node (OUTB).

The fourth transistor (M4) may include a fourth gate connected to the inverted output node (OUTB), a fourth source connected to a second power or power supply 302, and a fourth drain connected to the output node (OUT).

For instance, the first and second transistors (M1 and M2) may be NMOS transistors, and the third and fourth transistors (M3 and M4) may be PMOS transistors. The embodiments of the disclosure are not limited thereto.

The output node (OUT) may be a node to which the drain of the second transistor (M2), the drain of the fourth transistor (M4) and the gate of the third transistor (M3) are linked. The inverted output node (OUT_B) may be a node to which the drain of the first transistor (M1), the drain of the third transistor (M3) and the gate of the fourth transistor M4) are linked.

A waveform converter 204-1 may be implemented and/or realized by an inverter or buffer having a time to pull up the output to a high level (a "high level pull up time" or simply "pull up time") that is different from the time to pull down the output to a low level (a "low level pull down time" or simply "pull down time").

A waveform inverter 204-1 includes a first converter 310 and a second converter 320.

The first converter 310 converts a waveform of the level shifted data signal (DL11) and generates a conversion data signal (DT11) (e.g., based on the result of the conversion).

Compared with the level shifted data signal (DL11), the conversion data signal (DT11) may have a rising time or pull up time that will be decreased and a descending time or pull down time that will be increased.

The conversion data signal (DT11) may have a rising time and descending time that are different from each other. For instance, the rising time of the conversion data signal (DT11) may be shorter than the descending time thereof.

For instance, the rising time of the conversion data signal (DT11) may be the time taken for a signal to reach the maximum value (e.g., similar to or the same as the pull up time).

Alternatively, the rising time may be the time taken for a signal to reach 10%-90% of the maximum value while the signal rises to the maximum value from the minimum value, but embodiments of the disclosure are not limited thereto.

The descending time may be the time taken for a signal to reach the minimum value (e.g., similar to or the same as the pull down time). Or, the descending time may be the time taken for a signal to reach 90%-10% of the maximum value while the signal descends from the maximum value to the minimum value, but embodiments of the disclosure are not limited thereto.

The first converter 310 may include a CMOS inverter configured to invert a level shifted data signal (DL11) and a first bias switch 316 connected to the CMOS inverter and that receives a first bias signal (Bias1). The first bias signal (Bias1) may be a signal that turns on the first bias switch 316. For example, the first converter 310 may include a first switch 312 and a second switch 314 receiving a common input, and the first bias switch 316 may be connected between the first switch 312 and the second switch 314.

The first converter 310 may output a conversion data signal (DT11) via a first output node (OUT1) to which the first bias switch 316 and one of the first and second switches 312 and 314 (e.g., the second switch 314) are linked.

For instance, the first witch 312 and the first bias switch 316 may be or comprise NMOS transistors, and the second switch 314 may be or comprise a PMOS transistor.

The first bias signal (Bias1) may be a bias voltage applied to the first bias switch 316 to limit the current(s) flowing between the first output node (OUT1) and the first power or power supply. The first bias switch 316 may limit the flow of current(s) between the first output node (OUT1) and the first power or power supply.

For instance, the first converter 310 may include a NMOS transistor 312 connected between the first power or power supply 301 and the first output node (OUT1), a PMOS transistor 314 connected between the second power or power supply 302 and the first output node (OUT1), and a NMOS transistor 316 connected between the output node (OUT1) and the NMOS transistor 312.

The level shifted data signal (DL11) may be input to a gate in each of the NMOS transistor 312 and the PMOS transistor 314, and the first bias signal (Bias1) may be input to a gate of the PMOS transistor 316.

When the level shifted data signal (DL11) has a low level, the second switch 314 may be turned on and the first switch 312 may be turned off, such that the conversion data signal (DT11) output to the first output node (OUT1) may rise to a second voltage (VDD2).

When the level shifted data signal (DL11) has a high level, the second switch 314 may be turned off and the first switch 312 may be turned on, such that the conversion data signal (DT11) output to the first output node (OUT1) may descend to a first voltage (VSS). While the conversion data signal (DT11) is descending to the first voltage (VSS), the bias switch 316 may be employed to delay the descending time of the conversion data signal (DT11) output to the first output node (OUT1) to the first voltage (VSS).

Assuming that the first switch 312, the second switch 314 and the first bias switch 316 have the same performance (e.g., the same switching speed), the current limitation of the first bias switch 316 between the first power or power supply (VSS) and the first output node (OUT1) may differentiate the rising time of the conversion data signal (DT11) from the descending time of the conversion data signal (DT11).

As shown in FIG. 3, the current limiting of the first bias switch 316 between the first power or power supply (VSS) and the first output node (OUT1) may make the rising time of the conversion data signal (DT11) shorter than the descending time of the conversion data signal (DT11).

The second converter 320 converts a waveform of an inverted level shifted data signal (D11_B) and generates an inverted conversion data signal (DT11_B) (e.g., based on the result of the conversion).

The second converter 320 may have the same structure as the first converter 310, except that the third switch 322 and the fourth switch 324 are turned on or off in response to the conversion level shifted data signal (DL11_B). For instance, the second converter 320 may include a CMOS inverter that inverts the inverted level shifted data signal (DL11_B), and a second bias switch 326 connected to the CMOS inverter and that receives the first bias signal (Bias1). The CMOS inverter may comprise a third switch 322 and a fourth switch 324 receiving a common input, and the second bias switch 326 may be connected between the third switch 322 and the fourth switch 324.

A waveform converter 204-1 according to another embodiment may be implemented or realized with a first buffer having two first converters 310 connected in series and a second buffer having two second converters 320 connected in series.

As mentioned above, a rising time of the inverted conversion data signal (DT11_B) may be different from a descending time. For instance, the second converter 310 may generate an inverted conversion data signal (DT11_B) having a rising time shorter than a descending time through a second output node (OUT2) at which the second bias switch 326 and the fourth switch 324 are linked.

Figure 6:
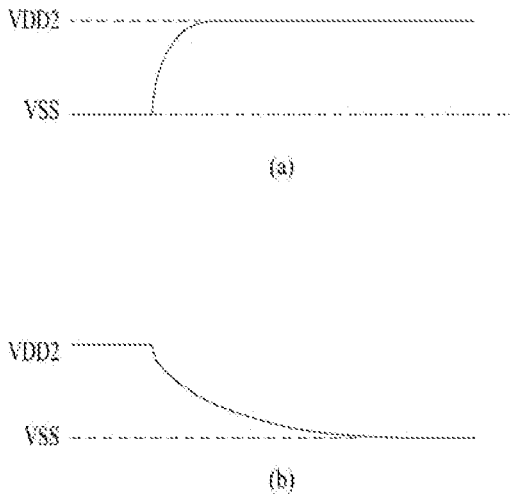
FIG. 6 is a diagram illustrating an exemplary converted data signal and exemplary rising and descending waveforms of an inverted signal, which are shown in FIG. 3.

FIG. 6 is a diagram illustrating a converted data signal and a rising waveform and a descending waveform of an inverted signal from circuitry shown in FIG. 3. FIG. 6*a* illustrates the rising waveform, and FIG. 6*b* illustrates the descending waveform.

The rising time of the conversion data signal (DT11) and the inverted conversion data signal shown in FIG. 6*a* is shorter than the descending time of the conversion data signal (DT11) and the inverted conversion data signal (DT11_B) shown in FIG. 6*b*.

The other waveform converters (204-2 through 204-8 may have the same structure as the waveform converter 204-1, and a repeated description thereof will be omitted accordingly.

Figure 4:
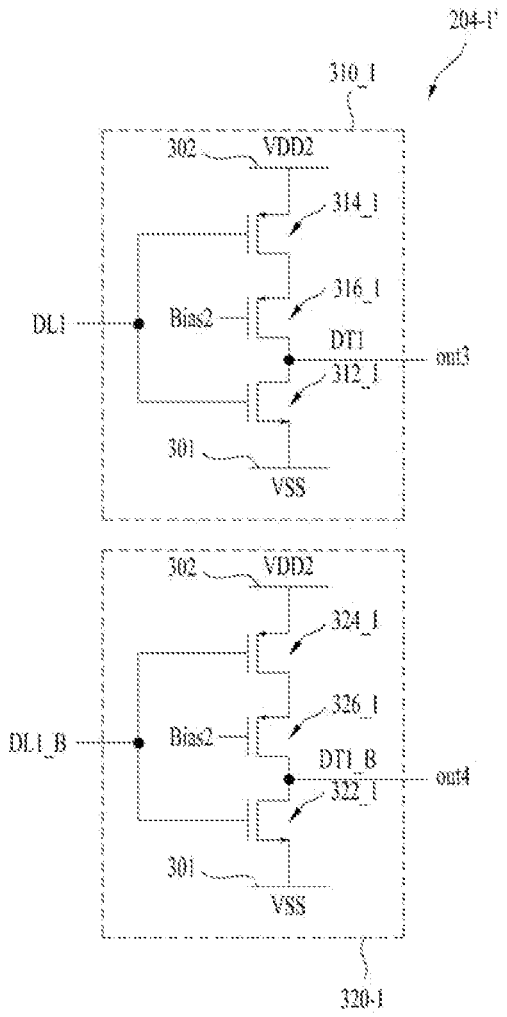
FIG. 4 is a diagram illustrating another embodiment of the waveform converter shown in FIG. 2.

FIG. 4 is a diagram illustrating another embodiment 204-1' of the waveform converter shown in FIG. 2.

Referring to FIG. 4, the waveform converter 204-1' may include a first converter 310-1 and a second converter 310-2.

The first converter 310-1 may include a first switch 312-1, a second switch 314-1 and a third bias switch 316-1.

The first converter 310-1 has the same structure as the first converter 310 shown in FIG. 3, except that the third bias switch 316 is a PMOS transistor, and the third output node (OUT3) is an access node between the first switch 312-1 and the third bias switch 316-1.

A second bias signal (Bias2) may be a bias voltage applied to the third bias switch 316-1 to limit current(s) flowing between a third output node (OUT3) and a second power or power supply (VDD2). The third bias switch 316-1 may limit flow of current(s) between the third output node (OUT3) and the second power or power supply (VDD2).

When the level shifted data signal (DL1) has a low level, the second switch 314-1 may be turned on and the first switch 312-1 may be turned off, such that the conversion data signal (DT11) output to the first output node (OUT3) may rise to a first voltage (VDD2).

When the level shifted data signal (DL1) has a high level, the second switch 314-1 may be turned off and the first switch 312-1 may be turned on, such that the conversion data signal (DT11) output to the first output node (OUT3) may descend to a first voltage (VSS).

Assuming that the first switch 312-1, the second switch 314-1, and the third bias switch 316-1 have the same performance (e.g., the same switching speed), the current limitation of the third bias switch 316-1 between the second power or power supply (VDD2) and the third output node (OUT3) may differentiate the rising time of the conversion data signal (DT11) from the descending time of the conversion data signal (DT11).

As shown in FIG. 4, the current limiting capability of the bias switch 316-1 between the second power or power supply (VDD2) and the third output node (OUT3) may make the rising time of the conversion data signal (DT11) longer than the descending time of the conversion data signal (DT11).

The second converter 320-2 may include a third switch 322-1, a fourth switch 324-1 and a fourth bias switch 326-1.

The second converter 320-2 may include the third switch 322-1, the fourth switch 324-1 and the fourth bias switch 326-1, and the second converter 320-1 may have the same structure as the first converter 310-1, except that the third switch 322-1 and the fourth switch 324-1 are turned on or off in response to the conversion level shifted data signal (DL11_B).

Accordingly, the rising time of the inverted conversion data signal (DT11-B) output from the fourth output node (OUT4)

of the second converter 320-1 may be longer than the descending time of the inverted conversion data signal (DT11_B).

Figure 7:
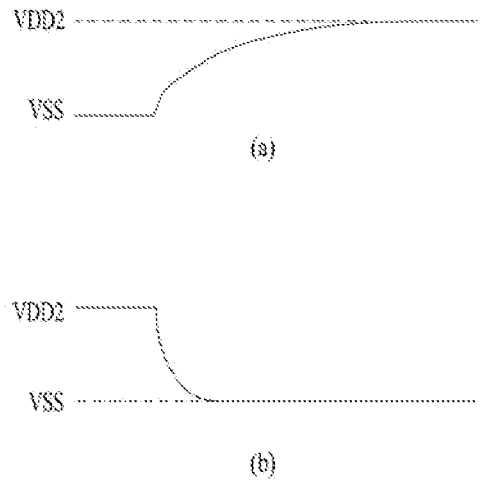
FIG. 7 is a diagram illustrating an exemplary converted data signal and exemplary rising and descending waveforms of an inverted signal, which are shown in FIG. 4.

FIG. 7 is a diagram illustrating a converted data signal and a rising waveform and a descending waveform of an inverted signal from circuitry shown in FIG. 4. FIG. 7*a* illustrates the rising waveform, and FIG. 7*b* illustrates the descending waveform.

The rising time of the conversion data signal (DT11) and the inverted conversion data signal shown in FIG. 7*a* is longer than the descending time of the conversion data signal (DT11) and the inverted conversion data signal (DT11_B) shown in FIG. 7*b*.

The other level shifter units (e.g., LS_2 through LS-N) and the waveform converters (TS_2 through TS_n) may have the same structure described above, referring to FIG. 4, and a repeated description thereof will be omitted accordingly.

The digital-analog conversion unit 160 may convert and/or transmit the output of the level conversion block 150. In other words, the digital-analog conversion unit 160 may convert a digital signal into an analog signal (Va1 through Van, where n is a natural number greater than 1).

The digital-analog conversion unit 160 may include digital analog converters (DAC_1 through DAC_n, where n is a natural number greater than 1) corresponding to the plurality of waveform converter units (TS_1 through TS_n, where n is a natural number greater than 1).

Each of the digital-analog converters (DAC_1 through DAC_n, where n is a natural number greater than 1) may perform digital-analog conversion with respect to the output of a corresponding one of the waveform converters (TS_1 through TS_n, where n is a natural number greater than 1).

For instance, the digital-analog converter (DAC-1) may convert conversion data signals (DT11 through DT18) provided by the waveform conversion unit (TS_1) and inverted conversion data signals (DT11 through DT18) into analog signals (Va1).

Figure 5:
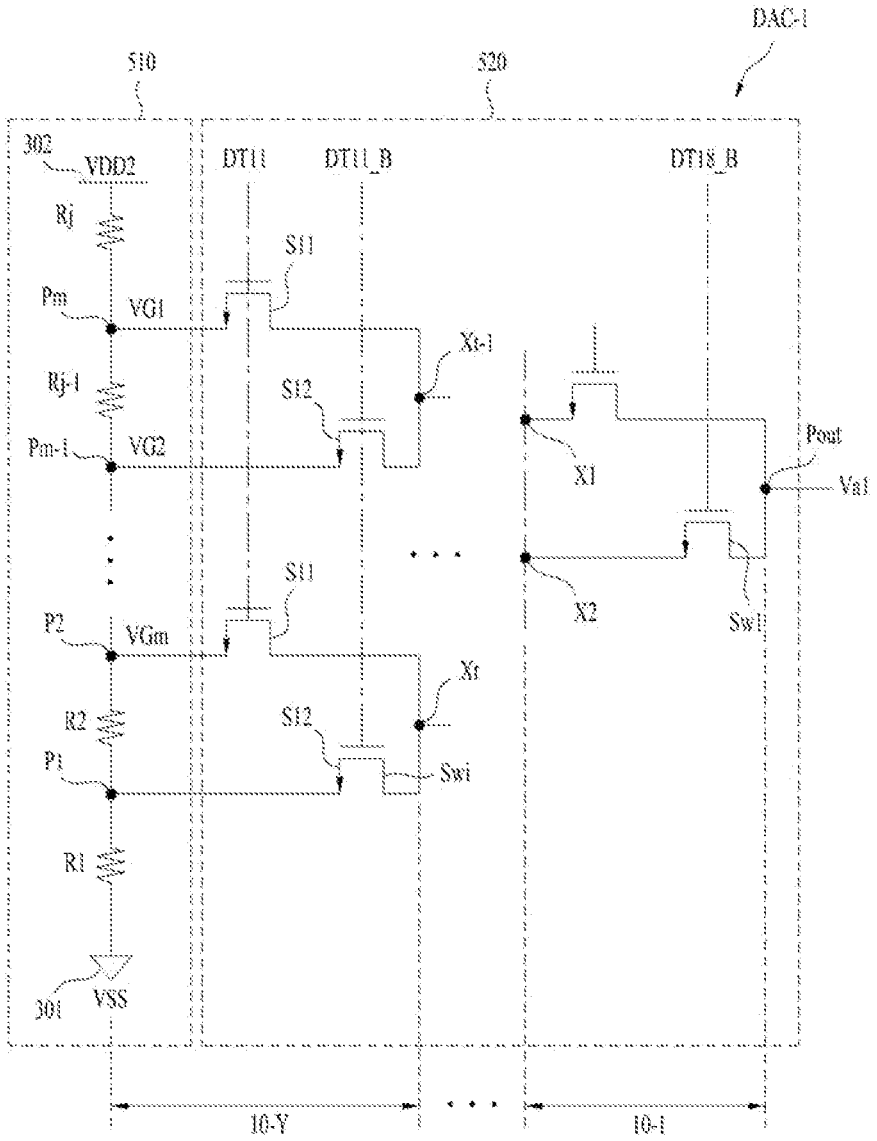
FIG. 5 is a diagram illustrating an exemplary digital-analog converter shown in FIG. 2.

FIG. 5 is a diagram illustrating the digital-analog converter (DAC_1) shown in FIG. 2. The digital-analog converters shown in FIG. 2 may have the same structure, and the structure of one such digital-analog converter will be described.

Referring to FIG. 5, the digital-analog converter (DAC_1) may include a voltage distributor 510 and a decoder 520.

The voltage distributor 510 may distribute voltages (VDD2) of the second power or power supply 302, (e.g., driving voltages (VDD2) of the level shifting block 140) and generate a plurality of distributed voltages (VG1 through VGm, where m is a natural number greater than 1) with different levels (e.g., based on the result of the distribution).

For instance, the voltage distributor 510 may be realized by a resistor-string having resistors (R1 through Rj, where j is a natural number greater than 1) connected between the first power or power supply 301 and the second power or power supply 302 in derail.

For instance, such the resistor string 510 (R-string) may include 2n−1 resistors when the number of the conversion data signals (DT11 through DT18) input to the decoder 520 is n.

The decoder 520 may decode digital conversion data signals (DT11 through DT18) provided by the waveform converter (204-1) and the inverted conversion data signals (DT11_B through DT18_B), and output one of the distributed voltages (VG1 through VGm, where m is a natural number greater than 1) from the voltage distributor 510 (e.g., based on the decoding or the result of the decoding).

The decoder 520 may include a plurality of switches (SW1 through SWi, where i is a natural number greater than 1) linked to access nodes (P1 through Pm, where m is a natural number greater than 1) between two resistors (e.g., R1 and R2~Rj−1 and Rj) selected from the resistors (R1 through Rj, where j is a natural number greater than 1) and an output node (Pout) of the decoder 520.

The switches (SW1 through SWi) may be turned on or off in response to conversion data signals (DT11 through DT18) and inverted conversion data signals (DT11 through DT18). One of the voltages (VG1 through VGm, where m is a natural number greater than 1) may be output to the output node (Pout) by the switches (SW1 through SWi). At this time, the output node (Pout) may be a node configured to output an analog signal (Va1).

The connection of the switches (SW1 through SWi) between access nodes (P1 through Pm, where m is a natural number greater than 1) of two neighboring resistors (e.g., R1 and R2~Rj−1 and Rj) selected from the resistors shown in FIG. 5 and an output node (Pout) may be one of embodiments.

For instance, the decoder 520 may include a first switch group through Y switch group (10-1 through 10-Y, where Y is a natural number greater than 1).

The Y switch group (10-Y) may include two Y switches (S11 and S12) serially connected between two neighboring access nodes (P1 and P2~Pm−1 and Pm) of the access nodes (P1 through Pm, where m is a natural number greater than 1).

A Y-1 switch group (10-(Y-1)) may include two Y-1 switches serially connected between two neighboring ones of the access nodes of the two T switches (S11 and S12) in the Y switch group (10-Y).

The number of the arranged decoders 520 may increase by 2y (y≥1, where y is a natural number of at least 1) between the output node (Pout) and the access nodes (P1 through Pm, where m is a natural number greater than 1) toward a first direction. The first direction may be toward the access nodes (P1 through Pm, where m is a natural number greater than 1).

For instance, the decoder 520 may include a plurality of access nodes (X1 through Xt, where t is a natural number greater than 1).

For instance, the first switch (SW1) may be connected to one of two first access nodes arranged in the foremost and the output node (Pout). The second switch may be connected to the other one of the two first access nodes and the output node (Pout).

For instance, the first switch may be connected to one of two X-access nodes selected from 2y nodes arranged in the Xth positions and one X-1th access node selected from 2y−1 arranged in X-1th positions. The second switch may be connected to the other one of the two X access nodes selected from the 2y nodes arranged in the Xth positions and one X-1th access node selected from the 2y−1 nodes arranged in the X-1th positions.

For instance, the first switch may be connected to one of the two access nodes selected from the access nodes (P1 and P2~Pm−1 and Pm) and one Xth access node selected from the X access nodes. The second switch may be connected to the other one of the two selected access nodes and the selected Xth access node.

For instance, the first switch may be turned on or off in response to non-inverted conversion data signals (DT11 through DT18), and the second switch may be turned on or off in response to inverted conversion data signals (DT11 through DT18).

The decoder 520 may have a connection structure of diverse switches to output to the output node (Pout) one of the distributed voltages (VG1 through VGm, where m is a natural number greater than 1) selected by activation of certain ones of the switches (SW1 through SWi) in response to the conversion data signals (DT11 through DT18) and inverted conversion data signals (DT11 through DT18).

The switches (SW1 through SWi) of the decoder 520 may be turned on or off in response to the conversion data signals (DT11 through DT18) and the inverted conversion data signals (DT11 through DT18).

The switches (SW1 through SWi) shown in FIG. 5 may be implemented as or realized by NMOS transistors, but embodiments of the present disclosure are not limited thereto. In another embodiment, the switches (SW1 through SWi) may be implemented as or realized by PMOS transistors.

The switches (SW1 through SWi, where i is a natural number greater than 1) shown in FIG. 5 may perform switching to make the turned-on time (On_Time) shorter than the turned-Off time (Off_Time).

For instance, when the switches (SW1 through SWi) are or comprise NMOS transistors, the waveform converters in the waveform conversion unit (TS_1) shown in FIG. 2 may be implemented as or realized by the embodiment shown in FIG. 4.

The rising time of the conversion data signal (DT11) and the inverted conversion data signal (DT11_B) output from the waveform converter 204-1 is longer than the descending time of the conversion data signal (DT11) and the inverted conversion data signal (DT11_B), such that the turned-on time of the switches (SW1 through SWi) may be shorter than the turned-off time.

For instance, when the switches (SW1 through SWi) are or comprise PMOS transistors, the waveform converters in the waveform conversion unit (TS_1) shown in FIG. 2 may be implemented as or realized by the embodiment 204-1 shown in FIG. 3.

The rising time of the conversion data signal (DT11) and the inverted conversion data signal (DT11_B) output from the waveform converter 204-1 is shorter than the descending time of the conversion data signal (DT11) and the inverted conversion data signal (DT11_B), such that the turned-on time of the switches (SW1 through SWi) can be shorter than the turned-off time.

Some of the switches (SW1 through SWi) may be turned on based on the conversion data signal (DT11) and the inverted conversion data signal (DT11_B) provided to the decoder 520, and other ones of the switches may be turned off. The one or more switches turned on may be first switches, and the one or more switches turned off may be second switches.

The conversion data signal (DT11) and the inverted conversion data signal (DT11_B) are provided to the decoder 520 simultaneously, to turning off the second switches and turn on the first switches.

In a conventional data driver, a constant power signal and a sub power signal provided by a level shifter may turn on or turn off switches in a decoder in a digital-analog converter. When the turned-on time of the constant power signal and the sub power signal is the same as the turned-off time thereof, there may be a short period in which the switch that is turned on by the constant power signal and the sub power signal and the switch that will be turned off are turned on simultaneously. Instant shortcut currents or through currents flowing through or from the resistor-string may be generated in that period. Such through currents may cause fluctuation(s) in the waveform of a distributed voltage from the resistor-string. As the level shifting speed of the level shifter becomes slower, the waveform of the distributed voltage may become larger by the through currents.

The fluctuation(s) may lengthen the time taken for the output of the digital-analog converter to reach a final voltage, and lower the digital-analog conversion speed.

In embodiments of this disclosure, the second switches are turned off first, and the first switches are turned on after that, so that there is no period in which the first switches and the second switches are turned on simultaneously. Accordingly, generation of the through currents can be prevented.

In embodiments of this disclosure, because no through currents are generated, current consumption can be reduced, and EMI can be improved.

In embodiments of this disclosure, the through currents are repressed, and fluctuation(s) in the distributed voltages (VG1 through VGm) are then repressed, and any reduction of the digital-analog conversion speed caused by the fluctuation(s) can be prevented.

Figure 8:
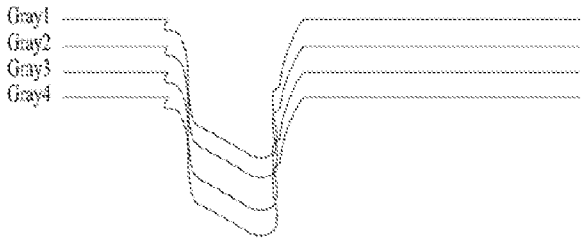
FIG. 8 is a diagram illustrating a waveform of a distributed voltage provided by a resistor string of a digital-analog converter in a conventional data driver.
Figure 9:
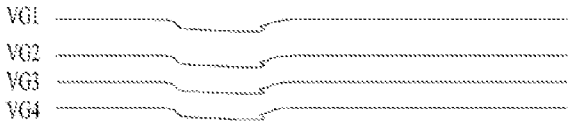
FIG. 9 is a diagram illustrating exemplary distributed voltages provided by a resistor string of an exemplary digital-analog converter in a data driver according to exemplary embodiments of the disclosure.

FIG. 8 is a diagram illustrating waveforms of distributed voltages provided by a resistor string of a digital-analog converter in a conventional data driver. FIG. 9 is a diagram illustrating exemplary distributed voltages provided by a resistor string 510 of a digital-analog converter (DAC-1) in the data driver 100 according to exemplary embodiments of the disclosure.

Fluctuations are generated in the distributed voltages (Gray1 through Gray4) shown in FIG. 8 by the through currents. In the embodiment(s) of FIG. 9, through currents in the distributed voltages (e.g., VG1 through VG4) provided by the resistor-string of the digital-analog converter may be repressed, and thus, little fluctuation may be generated.

The output unit 170 (FIG. 1) may amplify analog signals output from the digital-analog conversion unit 160, and it may include a plurality of amplifiers (A1 through An, where n is a natural number greater than 1) configured to output the amplified signals (A_out1 through A_outn, where n is a natural number greater than 1).

Each of the amplifiers (A1 through An, where n is a natural number greater than 1) may amplify and output the analog signal from a corresponding one of the digital-analog converters (DAC1 through DACn, n>1 which is a natural number greater than 1).

Figure 10:
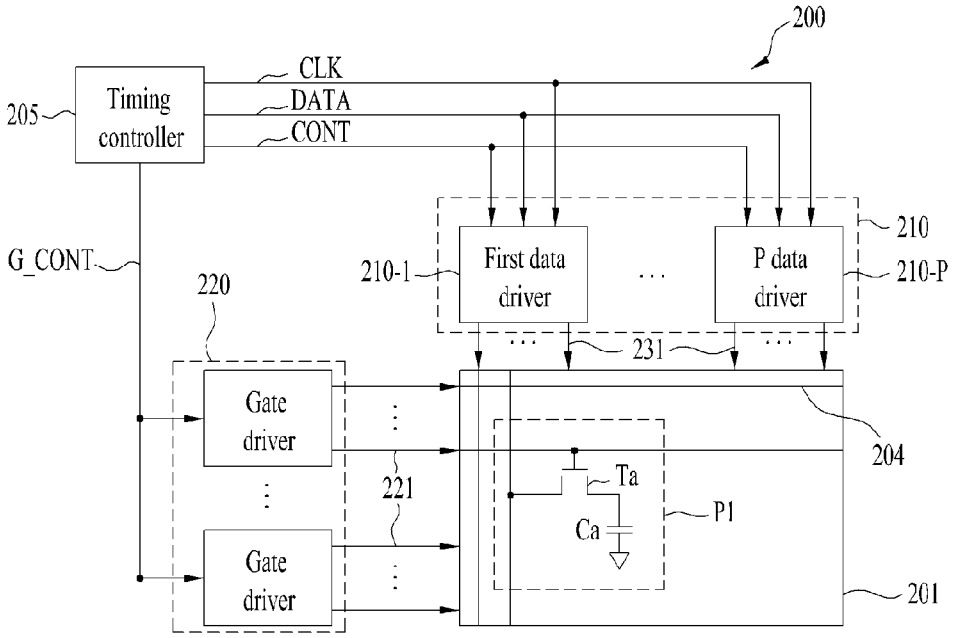
FIG. 10 is a diagram illustrating an exemplary display apparatus including the data driver according to exemplary embodiments of the disclosure.
Figure 11:
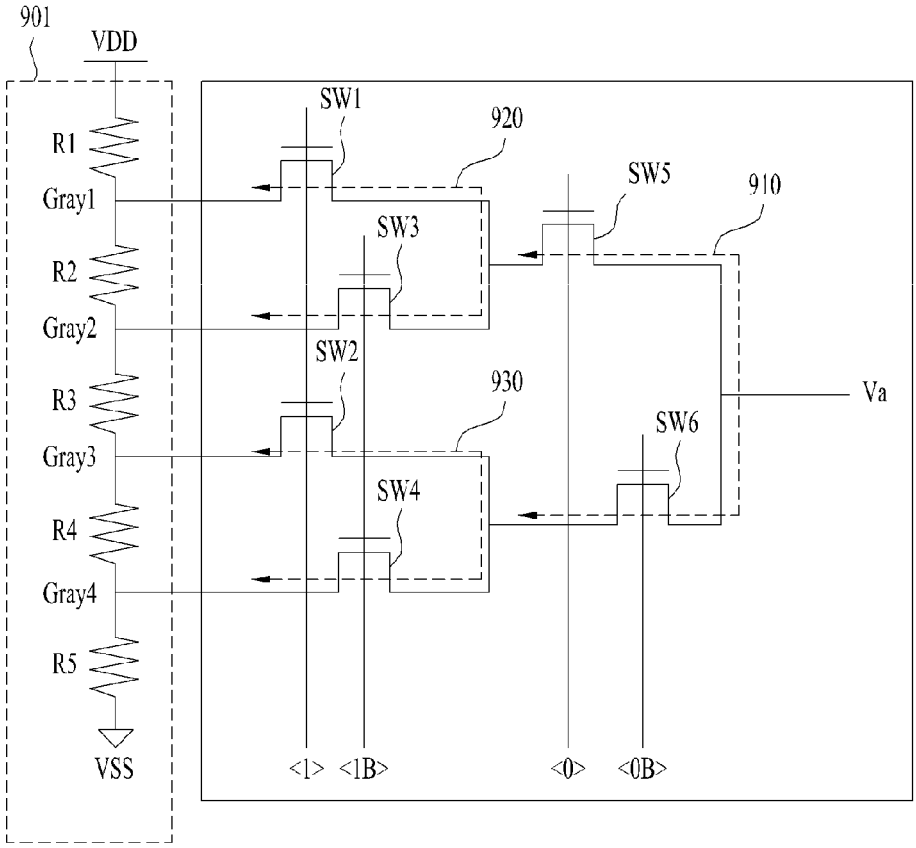
FIG. 11 is a diagram illustrating a conventional resistor string distribution type digital-analog converter.

FIG. 10 is a diagram illustrating a display apparatus including the data driver 100 according to embodiments of the disclosure.

Referring to FIG. 10, the display apparatus 200 may include a display panel 201, a timing controller 205, a data driver unit 210 and a gate driver unit 220.

The display panel 201 may include gate lines 221 arranged in rows and data lines 231 arranged in columns (or vice versa), with the gate lines 221 and the data lines crossing each other in a matrix, and pixels (e.g., P1) connected to crossed portions of the gate lines and the data lines (e.g., connected to each of a gate line and a data line near a crossing point of the gate line and the data line). A plurality of such pixels (P1) may be provided, and each of the pixels (P1) may include a transistor (Ta) and a capacitor (Ca).

The timing controller 205 may output a clock signal (CLK), data (DATA), a data control signal (CONT) that controls the data driver 210, and a gate control signal (G_CONT) that controls the gate driver 220.

For instance, the data control signal (CONT) may include a horizontal start signal that is input to a shift register (110, see FIG. 1), a first control signal (LD), and an enable signal (En). The clock signal (CLK) may control the timing of the horizontal start signal, first control signal, and/or enable signal (e.g., at time at which the signal is activated) to control the flow of data through the various circuitry in the data driver 100 and/or the display apparatus 200.

The gate driver unit 220 may drive the gate lines and include a plurality of gate drivers. The gate driver unit 220 may output a gate control signal 221 that controls a transistor (Ta) of the pixel to the gate lines.

The data driver unit 210 may drive data lines and include a plurality of data drivers (210-1 through 210-P, where P is a natural number greater than 1). Each of the data drivers 210-1 through 210-P, where P is a natural number greater than 1) may be as described herein for the embodiment 100 shown in FIG. 1.

The display apparatus may enhance the digital-analog conversion speed of the digital-analog converter in the data drive. Accordingly, a high resolution screen quality may be realized.

Specifications and variations can be made in the present disclosure without departing from the spirit or scope of the disclosed subject matter. Thus, it is intended that the present disclosure cover the modifications and variations of the disclosed subject matter provided they come within the scope of the appended claims and their equivalents.

What is claimed is:

1. A data driver comprising:

a data storage unit configured to store a data signal therein;

a level shifting block configured to shift a level of the data signal and output a level shifted data signal;

a waveform conversion block configured to convert a waveform of the level shifted data signal and generate a conversion data signal; and a digital-analog conversion unit configured to output an analog signal based on the conversion data signal, wherein the conversion data signal has a rising time and a descending time that are different from each other.

2. The data driver of claim 1, wherein the digital-analog conversion unit comprises:

a voltage distribution unit comprising resistors serially connected between a first power or power supply and a second power or power supply, to output distributed voltages, each with a different level; and a decoder comprising a plurality of switches turned on or turned off in response to the conversion data signal, the decoder configured to output one of the distributed voltages.

3. The data driver of claim 2, wherein the waveform conversion block comprises an inverter having a high level pull up time and a low level pull down time that is different from the high level pull up time.

4. The data driver of claim 2, wherein the waveform conversion block comprises:

a CMOS inverter configured to invert the level shifted data signal;

a first bias switch connected to the CMOS inverter and that receives a first bias signal; and an output node to which the first bias switch and the second switch are linked, and which outputs the conversion data signal.

5. The data driver of claim 4, wherein the first switch and the first bias switch comprise NMOS transistors, and the second switch comprises a PMOS transistor.

6. The data driver of claim 4, wherein the second switch comprises a NMOS transistor, and the bias switch and the first switch comprise PMOS transistors.

7. The data driver of claim 1, wherein the level shifted data signal comprises a non-inverted level shifted data signal and an inverted level shifted data signal, and the inverted level shifted data signal is an inverted signal of the non-inverted shifted data signal.

8. The data driver of claim 7, wherein the conversion data signal comprises a non-inverted conversion signal and an inverted conversion data signal, and the inverted conversion data signal is an inverted signal of the non-inverted conversion data signal.

9. The data driver of claim 8, wherein the non-inverted conversion data signal has a rising time and a descending time that are different from each other, and the inverted conversion data signal has a rising time and a descending time that are different from each other.

10. The data driver of claim 1, wherein the rising time of the conversion data signal is shorter than the descending time of the conversion data signal.

11. The data driver of claim 1, wherein the rising time of the conversion data signal is longer than the descending time of the conversion data signal.

12. A data driver comprising:

a data storage unit configured to store a data signal therein;

a level shifting block configured to shift a level of the data signal and output a level shifted data signal;

a waveform conversion block configured to convert a waveform of the level shifted data signal and generate a conversion data signal; and a plurality of digital-analog conversion units comprising (i) a voltage distributor configured to output distributed voltages, each with a different level and (ii) a plurality of switches turned on or off in response to the conversion data signal, configured to output one of the distributed voltages, wherein each of the switches has a turned-on time and a turned-off time that is different from the turned-on time.

13. The data driver of claim 12, wherein each turned-off time of the switches is shorter than each turned-off time of the switches.

14. The data driver of claim 12, wherein the voltage distributor comprises resistors serially connected between a first power or power supply and a second power or power supply.

15. The data driver of claim 12, wherein the level shifting block comprises a plurality of level shifters, wherein each of the level shifters shifts a level of the data signal and a level of the inverted data signal, and outputs a non-inverted level shifted data signal and an inverted level shifted data signal.

16. The data driver of claim 15, wherein the waveform conversion block comprises a plurality of wave converters corresponding to the plurality of the level shifters, each of the waveform converters generates a waveform of the non-inverted level shifted data signal and a waveform of the inverted level shifted data signal and generates a non-inverted conversion data signal and an inverted conversion data signal, and the switches are turned on or turned off in response to the non-inverted level shifted data signal and the inverted level shifted data signal.

17. The data driver of claim 16, wherein each of the waveform converters comprises an inverter having a high level pull up time and a low level pull down time that is different from the pull-up time.

18. The data driver of claim 16, wherein each of the waveform converters comprises:

a CMOS inverter configured to invert the level shifted data signal; and a first bias switch connected to the CMOS inverter and that receives a first bias signal, and an output node to which the first bias switch and the second switch are linked, and which outputs the conversion data signal.

19. The data driver of claim 18, wherein the first switch and the first bias switch comprise NMOS transistors and the second switch comprises a PMOS transistor, or the second switch comprises a NMOS transistor and the bias switch and the first switch comprise PMOS transistors.

20. A display apparatus comprising:

a display panel having gate lines and data lines crossing each other in a matrix, and pixels connected to crossed portions of the gate lines and the data lines;

a gate driver configured to drive the gate lines; and a data driver configured to drive the data lines, wherein the data driver comprises:

a data storage unit configured to store a data signal therein;

a level shifting block configured to shift a level of the data signal and output a level shifted data signal;

a waveform conversion block configured to convert a waveform of the level shifted data signal and generate a conversion data signal; and a plurality of digital-analog conversion units comprising a voltage distributor configured to output distributed voltages, each with a different level, and a plurality of switches turned on or off in response to the conversion data signal and configured to output one of the distributed voltages, wherein the conversion data signal has a rising time and a descending time that are different from each other.

* * * * *